US009597918B2

(12) United States Patent
Jersa, III et al.

(10) Patent No.: US 9,597,918 B2
(45) Date of Patent: Mar. 21, 2017

(54) SMART CLIP

(71) Applicants: Michael Joseph Jersa, III, Wildwood, MO (US); Suhasini Balachandran, Wildwood, MO (US)

(72) Inventors: Michael Joseph Jersa, III, Wildwood, MO (US); Suhasini Balachandran, Wildwood, MO (US)

( * ) Notice: Subject to any disclaimer, the term of this patent is extended or adjusted under 35 U.S.C. 154(b) by 230 days.

(21) Appl. No.: 14/534,189

(22) Filed: Nov. 6, 2014

(65) Prior Publication Data

US 2016/0091866 A1 Mar. 31, 2016

Related U.S. Application Data

(60) Provisional application No. 62/057,307, filed on Sep. 30, 2014.

(51) Int. Cl.

| | |
|---|---|
| ***G04B 47/00*** | (2006.01) |
| ***G04G 9/08*** | (2006.01) |
| ***G04G 17/08*** | (2006.01) |
| ***B42F 1/02*** | (2006.01) |
| ***B42F 1/00*** | (2006.01) |
| ***G04F 1/00*** | (2006.01) |
| ***G04F 3/08*** | (2006.01) |

(52) U.S. Cl.

CPC ..... *B42F 1/02* (2013.01); *B42F 1/006* (2013.01); *G04B 47/00* (2013.01); *G04F 1/005* (2013.01); *G04F 3/08* (2013.01); *G04G 9/08* (2013.01); *G04G 17/08* (2013.01)

(58) Field of Classification Search

CPC ... G04B 47/00; G04F 3/06; G04F 3/08; G04F 1/005; G04G 9/08; G04G 17/08; B42F 1/02; B42F 1/006

See application file for complete search history.

(56) References Cited

U.S. PATENT DOCUMENTS

| | | | | |
|---|---|---|---|---|
| 4,637,732 | A * | 1/1987 | Jones | G04C 10/04 340/309.16 |
| 4,705,408 | A * | 11/1987 | Jordi | G04B 37/1426 224/903 |
| D313,758 | S * | 1/1991 | Klose | D10/15 |
| 5,293,354 | A * | 3/1994 | Costabile | G04F 8/08 368/11 |
| 5,327,115 | A | 7/1994 | Swierczek | |
| 6,008,720 | A * | 12/1999 | Hongu | G04G 13/021 340/309.16 |
| 6,603,711 | B2 * | 8/2003 | Calace | A63B 71/0605 368/10 |
| 6,696,972 | B1 * | 2/2004 | Bryans | G08C 19/28 340/12.22 |

(Continued)

FOREIGN PATENT DOCUMENTS

| | | |
|---|---|---|
| EP | 0653086 B1 | 3/2000 |
| EP | 1577812 B1 | 8/2008 |

*Primary Examiner* — Vit W Miska

(57) ABSTRACT

A method and apparatus for receiving an expiry time in a smart clip and one of timing and counting down to the expiry time comprises coupling an electronic receiver to the smart clip and connecting a timer to the electronic receiver are disclosed. Receiving the expiry time by the electronic receiver, and one of timing and counting down to the expiry time by the timer are also disclosed. Other features and embodiments of the invention are also disclosed.

20 Claims, 1 Drawing Sheet

(56) References Cited

U.S. PATENT DOCUMENTS

| | | | | |
|---|---|---|---|---|
| 7,167,419 | B2 * | 1/2007 | Kwan | A47J 31/52 224/903 |
| 7,318,293 | B2 | 1/2008 | Ardern, II | |
| D576,889 | S * | 9/2008 | Mandel | D10/15 |
| 7,522,046 | B2 | 4/2009 | Decker et al. | |
| 7,577,264 | B2 | 8/2009 | Caploon | |
| D614,051 | S * | 4/2010 | Cooney | D10/40 |
| 7,885,146 | B2 | 2/2011 | Parkinson et al. | |
| 8,050,429 | B2 | 11/2011 | Caploon | |
| 8,054,174 | B1 * | 11/2011 | Uehran | A63B 71/0605 273/317.3 |
| 8,701,560 | B2 * | 4/2014 | Condit | F23Q 21/00 102/215 |
| 2002/0172095 | A1 * | 11/2002 | Pandipati | G04R 20/00 368/47 |
| 2003/0117272 | A1 * | 6/2003 | Fegley | G04C 21/18 340/309.3 |
| 2004/0184354 | A1 * | 9/2004 | McDonald | G04G 21/04 368/3 |
| 2007/0036037 | A1 * | 2/2007 | Barbeau | G04B 37/1433 368/316 |
| 2007/0183269 | A1 * | 8/2007 | Baba | G04F 1/005 368/110 |
| 2007/0281524 | A1 | 12/2007 | Pomerantz | |
| 2008/0025150 | A1 * | 1/2008 | Sandy | G04B 37/1426 368/10 |
| 2010/0117822 | A1 * | 5/2010 | Hyatt | G08B 21/0269 340/539.12 |
| 2013/0316649 | A1 * | 11/2013 | Newham | H04W 88/04 455/41.2 |
| 2014/0219065 | A1 * | 8/2014 | Novak | G04F 1/005 368/29 |

* cited by examiner

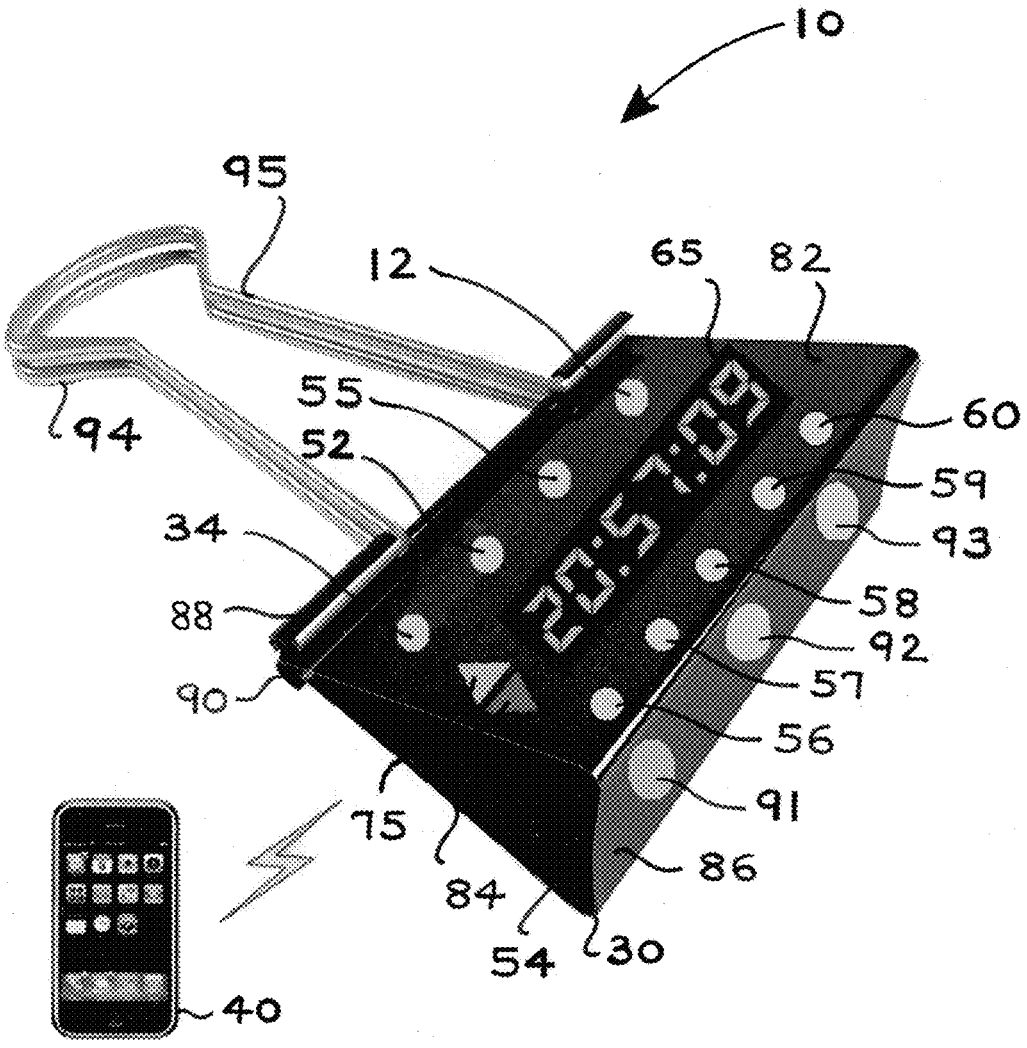
10
95
12
65
82
55
60
94
52
59
34
93
88
58
92
90
57
56
91
75
86
84
54
30
40

SMART CLIP

FIELD OF THE INVENTION

This invention relates to a smart clip, and more particularly to a method and apparatus for connecting a clip to an electronic device.

BACKGROUND OF THE INVENTION

Most consumers employ clips for securing documents. A traditional clip has a substantially triangular cross sectional shape and includes an upper surface, a lower surface and a connecting surface. Actuating arms are provided on the upper surface and the lower surface of the clip for opening the clip by a user. Consequently, apart from securing documents, the user may not be able to utilize the clip for performing any other function. Moreover, during circumstances in which it is required to program an expiry date of a document, the user may be unable to do so. Consequently, the user may not be able to exploit a utility value of the clip in a best possible manner. Therefore, there exists a need for a clip with an electronic receiver and display panel that would enable the user to interactively use the clip for performing a number of electronic functions, as well as for securing documents.

BRIEF DESCRIPTION OF THE INVENTION

In one aspect, a method is described for receiving an expiry time in a smart clip and one of timing and counting down to the expiry time. The method comprises coupling an electronic receiver to the smart clip and connecting a timer to the electronic receiver. The method further comprises receiving the expiry time by the electronic receiver, and one of timing and counting down to the expiry time by the timer.

In another aspect of the invention, a smart clip is described. The smart clip comprises an upper surface, a lower surface, and a connecting surface that connects the upper surface and the lower surface. An electronic receiver is coupled to one of the upper surface, the lower surface, and the connecting surface. The electronic receiver receives an expiry time. A timer is connected to the electronic receiver, wherein the timer one of times and counts down to the expiry time.

In another aspect of the invention, a smart clip is described. The smart clip comprises an upper surface, a lower surface, and a connecting surface that connects the upper surface and the lower surface. A camera is coupled to one of the upper surface, the lower surface, and the connecting surface, wherein the camera captures at least one of a photographic image and a video recording.

In yet another aspect of the invention, a smart clip is described. The smart clip comprises an upper surface, a lower surface, and a connecting surface that connects the upper surface and the lower surface. A control unit is coupled to one of the upper surface, the lower surface, and the connecting surface. A first light emitting diode and a second light emitting diode are connected to the control unit, wherein the control unit activates the first light emitting diode to glow during a first time interval, and wherein the second light emitting diode is activated to glow during a second time interval. The second time interval occurs at an expiry of the first time interval.

Other features will be in part apparent and in part pointed out hereinafter.

BRIEF DESCRIPTION OF THE DRAWINGS

FIG. 1 is a schematic representation of a smart clip in electronic communication with an electronic device.

DETAILED DESCRIPTION OF THE INVENTION

There has been developed a smart clip to satisfy many users' document programming and document securing requirements. The smart clip itself is compact and may be easily connected with electronic devices of various types such as cell phones, remote control devices, wrist watches, computer systems, etc. It is a versatile device which can be used to receive/transmit electronic signals from/to an electronic device as well as perform a function of attaching things and attaching to things. Importantly, the smart clip is efficient in operation.

FIG. 1 is a schematic representation of a smart clip and electronic device 10. More specifically, in the exemplary embodiment, a smart clip 30 is in electronic communication with an electronic device 40. The smart clip 30 is a resilient device that comprises an upper surface 82, a lower surface 84, and a connecting surface 86 that connects the upper surface 82 and the lower surface 84. The smart clip 30 is substantially triangular in cross section. The upper surface 82 and the lower surface 84 contact each other at an upper gripping edge and a lower gripping edge. The connecting surface 86 may be a spring member connected between the upper surface 82 and the lower surface 84. In an alternate embodiment, the connecting surface 86 may be a bow shaped member as found in a binder clip. In yet another alternate embodiment, the connecting surface 86 may be any type of member that connects the upper surface 82 and the lower surface 84. In an embodiment, the smart clip 30 is an article timing device. All electronic components may be coupled to the article timing device.

A first tubular hinge hook 88 is provided at the upper surface 82 and a second tubular hinge hook 90 is provided at the lower surface 84 of the smart clip 30. Specifically, the first tubular hinge hook 88 rotatably retains a first metallic wire actuating arm 95 and the second tubular hinge hook 90 rotatably retains a second metallic wire actuating arm 94. Alternatively, the first metallic wire actuating arm 95 and the second metallic wire actuating arm 94 may each be manufactured from any material known in the art that facilitates functioning of the first metallic wire actuating arm 95 and the second metallic wire actuating arm 94. The smart clip 30 is opened by applying force at an end portion of the first metallic wire actuating arm 95 and an end portion of the second metallic wire actuating arm 94. The first metallic wire actuating arm 95 and the second metallic wire actuating arm 94 pivot at the first tubular hinge hook 88 and the second tubular hinge hook 90 respectively. Force at the end portion of the first metallic wire actuating arm 95 and the end portion of the second metallic wire actuating arm 94 is released to close the smart clip 30 and firmly grip a plurality of documents between the upper gripping edge and the lower gripping edge. Alternatively, any article known in the art may be gripped between the upper gripping edge and the lower gripping edge.

While the present embodiment is described with respect to a binder clip, it is recognized that the smart clip 30 may be any type of clip known in the art that is capable of retaining an article therein. The smart clip 30 includes but is not limited to a binder clip, a paper clip, a spring clip, a bulldog clip, tongs, and the like. In an embodiment, the smart clip 30 may be secured to a file, wherein the file may be used to retain a plurality of documents. In an alternate embodiment, the smart clip 30 may be secured to any type of document retaining device known in the art to facilitate retaining the plurality of documents therein.

The electronic device 40 may be a cell phone, a remote control device, a computer system, a smart clip, a wrist watch, or any other wireless electronic device known in the art that is capable of transmitting an electronic signal to the smart clip 30. The electronic device 40 is configured to transmit an electronic signal to the smart clip 30. More specifically, electronic device 40 is configured to transmit the electronic signal to the smart clip 30 through an electronic transmitter (not shown) that is coupled to the electronic device 40. In an exemplary embodiment, the electronic signal includes programming information including a document expiry date/time for a document. In addition, the electronic signal may be any type of electromagnetic signal that facilitates operation of the smart clip and electronic device 10 as described herein.

In the exemplary embodiment, smart clip 30 includes an electronic receiver 34 coupled to one of the upper surface 82, the lower surface 84, and the connecting surface 86 of the smart clip 30. Electronic receiver 34 is configured to be electronically connected to the electronic transmitter that is coupled to the electronic device 40 and receives the electronic signal transmitted from the electronic transmitter. In an exemplary embodiment, electronic receiver 34 may be a wireless radio receiver, a wireless Bluetooth® receiver, a wireless CDMA receiver, 3G signal receiver, 4G signal receiver, and the like, depending on a signal range required by the user for receiving the electronic signal from the electronic transmitter coupled to the electronic device 40. Alternatively, electronic receiver 34 may be any type of wireless electronic receiver known in the art that receives the electronic signal from the electronic transmitter coupled to the electronic device 40.

Smart clip 30 includes a memory unit 52 coupled to the smart clip 30. Memory unit 52 is electronically connected to the electronic receiver 34 and acquires and stores the electronic signal from the electronic receiver 34. More specifically, memory unit 52 acquires and stores a finite list of entries that includes a finite number of document expiry dates/times from the electronic receiver 34. Memory unit 52 is further configured to automatically delete the oldest of the stored document expiry dates/times in chronological order as the latest document expiry dates/times are continuously acquired and stored in the memory unit 52 from the electronic receiver 34. The memory unit 52 is also adapted to store games, customizable time displays, alarm clock, calendar, calculator, etc. which may be displayed when required by the user. In an exemplary embodiment, the memory unit 52 may be any memory device such as but not limited to a computer chip, an integrated circuit, a memory card, a memory stick, a flash card, a magnetic drive, a hard disk, a magnetic medium, a micro drive, and the like. In an exemplary embodiment, the smart clip 30 may be provided with a slot (not shown) on one of the upper surface 82, the lower surface 84, and the connecting surface 86 of the smart clip 30 for receiving the memory unit 52 therein.

In the exemplary embodiment, smart clip 30 includes a timer 55 that is coupled to the smart clip 30. The timer 55 contains an internal clock mechanism controlled by a microcontroller coupled to the smart clip 30. The timer 55 is electronically connected to the electronic receiver 34 and is configured to time forward/countdown from a current time until a document expiry time. The timer 55 is pre-programmed with a program detailing a time remaining from a current time until a document expiry time. The timer 55 receives a signal from the electronic receiver 34 indicating at least one time required to be timed/counted down until document expiry. A display panel 65 is connected to the timer 55. After the timer 55 has been programmed, the display panel 65 displays timing to the document expiry time/count down from the current time until the document expiry time. After the document expiry time has been programmed in the timer 55, the electronic receiver 34 may receive one or more electronic signals that correspond to multiple expiry times of the same/multiple documents that are coupled to the smart clip 30.

The internal clock mechanism of the smart clip 30 may be programmed to receive a current date and an expiry date from the electronic receiver 34. Alternatively, the internal clock mechanism of the smart clip 30 may be programmed to receive an expiry time, wherein the expiry time may be a number of years, a number of months, and a number of days from the present time to the expiry time. For example, the internal clock mechanism may be programmed to receive a current date such as Oct. 1, 2014 to an expiry date such as Dec. 25, 2016. In an alternate example, the internal clock mechanism of the smart clip 30 may be programmed to expire from a present time to an expiry time in zero years, four months, and ten days. The internal clock mechanism of the smart clip 30 may also be configured to store a number of hours, a number of minutes, and a number of seconds from the present time to the expiry time. The timer 55 receives the current date and the expiry date/expiry time from the electronic receiver 34. The date setting option of the smart clip 30 enables the timer 55 to count down from the current date to the expiry date. Alternatively, the date setting option of the smart clip 30 enables the timer 55 to time from the current date to the expiry date. The time setting option of the smart clip 30 enables the timer 55 to count down from the present time to the expiry time. Alternatively, the time setting option of the smart clip 30 enables the timer 55 to time from the present time to the expiry time. The terms 'current date'/'present time' are used interchangeably, and the terms 'expiry date'/'expiry time' are used interchangeably in the specification and the claims. In addition, the terms 'date'/'time' are used interchangeably in the specification and the claims. After a specific 'expiry date'/'expiry time' has been programmed, multiple 'expiry dates'/'expiry times' may be programmed in the timer 55 for the same/multiple documents by sequentially transmitting electronic signals representing multiple 'expiry dates'/'expiry times' from the transmitter of the electronic device 40.

In an exemplary embodiment, smart clip 30 includes a plurality of selector option switches. The selector option switches may be operated by the user to program a document expiry date/document expiry time. The selector option switches may be touch screen selectors. Smart clip 30 includes a control unit 12 coupled to one of the upper surface 82, the lower surface 84, and the connecting surface 86 of the smart clip 30. The control unit 12 may be connected to an electrical circuit that is connected to the timer 55. More specifically, the control unit 12 may be programmable by the user using the PSET switch 56, year switch 57, month switch 58, day switch 59, upper/lower arrow toggle switches 75, and SET switch 60 that may be provided on one of the upper surface 82, the lower surface 84, and the connecting surface 86 and connected to the control unit 12 through a control flow path to set a document expiry time/document expiry date in the timer 55. The timer 55 may automatically be controlled by the control unit 12 to turn off and attain a sleep mode to conserve battery power. At periodic time intervals, the control unit 12 may automatically reactivate the timer 55 that is coupled to the smart clip 30. Therefore, the document expiry date/document expiry time may be programmed manually using the selector option switches/touch screen selectors provided on the smart clip 30. Alternatively, the smart clip 30 may be programmed by wirelessly programming the document expiry time/document expiry date using the transmitter of the electronic device 40 that is electronically connected to the electronic receiver 34 of the smart clip 30. The display panel 65 indicating timing to/countdown to the document expiry time/document expiry date may be activated by touching any portion of the smart clip 30. Specifically, a touch sensor/touch switch/tactile sensor may be coupled to smart clip 30 and activates the countdown/timing displayed on the display panel 65 when the user touches any portion of the smart clip 30.

The PSET switch 56 allows the user to select the year, month, or day selection. Specifically, the year switch 57 allows the user to select the year, the month switch 58 allows the user to select the month, and the day switch 59 allows the user to select the day. The upper/lower arrow toggle switches 75 allow the user to toggle to the required year, month, and day at which expiry occurs. The SET switch 60 allows the user to confirm the selection of the year, month, and date in the smart clip 30. In an alternate embodiment, a single switch may be used to select the year/month/day.

Smart clip 30 includes an electronic transmitter (not shown) that is electronically connected to one of the timer 55 and the control unit 12 of the smart clip 30. The electronic transmitter is configured to be electronically connected to an electronic receiver coupled to the electronic device 40 and is configured to transmit an expiry notification signal to the electronic device 40 to notify the user that an expiry date/expiry time of the document is reached. In an exemplary embodiment, the electronic transmitter may be a wireless radio transmitter, a wireless CDMA transmitter, a wireless Bluetooth® transmitter, 3G signal transmitter, 4G signal transmitter, and the like depending on a signal range required by the user for transmitting the expiry notification signal to the electronic device 40. Alternatively, the electronic transmitter may be any type of wireless electronic transmitter known in the art that transmits the expiry notification signal to the electronic receiver coupled to the electronic device 40, in an alternate embodiment, the expiry notification signal may be transmitted to a speaker coupled to the smart clip 30. In yet another exemplary embodiment, the electronic receiver 34 and the electronic transmitter of the smart clip 30 may be replaced by an integrated electronic receiver/transmitter that is capable of receiving/transmitting electronic signals from/to the electronic device 40.

In an exemplary embodiment, smart clip 30 includes a vibrating unit (not shown) that is electronically connected to one of the memory unit 52, the timer 55, the electronic transmitter, and the control unit 12 and is configured to vibrate when the electronic signal is received from one of the memory unit 52, the electronic transmitter, the control unit 12, and the timer 55. More specifically, one of the memory unit 52, the electronic transmitter, the control unit 12, and the timer 55 facilitates actuating the vibrating unit when an expiry time/expiry date of the document is attained. As a consequence of the vibrations sensed by the user, the user is cognizant that the expiry time/expiry date of the document has been attained. Alternatively, an audible alarm may be connected to one of the memory unit 52, the electronic transmitter, the control unit 12, and the timer 55 and emits an alarm that enables the user to be cognizant when the expiry time/expiry date of the document has been attained. The audible alarm may emit an alarm to alert the user of a location of the smart clip 30 in the event that the smart clip 30 has been misplaced within a certain location such as within a residential home when the electronic device 40 is operated by the user. Alternatively, an ultrasonic frequency noise generator may be connected to one of the memory unit 52, the electronic transmitter, the control unit 12, the timer 55, and emits an ultrasonic noise signal that enables the user to be cognizant when an expiry time/expiry date of the document has been attained. As a consequence of the ultrasonic frequency signal sensed by the user, the user is cognizant that an expiry time/expiry date of the document has been attained.

The smart clip 30 includes a feature wherein the document expiry time/document expiry date may be keyed using touch screen selectors provided on one of the upper surface 82, the lower surface 84, and the connecting surface 86 of the smart clip 30. In an alternate exemplary embodiment, the smart clip 30 includes a feature wherein the user can speak a document expiry time/document expiry date into a microphone (not shown) provided on one of the upper surface 82, the lower surface 84, and the connecting surface 86 of the smart clip 30. The document expiry time/document expiry date that is spoken into the microphone may be deciphered within the smart clip 30 and displayed on the display panel 65.

Smart clip 30 is further configured to receive an electronic signal in real-time by the electronic receiver 34 from the electronic transmitter that is coupled to the electronic device 40. In an exemplary embodiment, the electronic signal received by the electronic receiver 34 in real-time comprises a current date and current time. The electronic signal comprising the current date and current time may be digitally displayed on the display panel 65 of the smart clip 30. Moreover, smart clip 30 may be further configured to receive a variety of continuous/intermittent electronic signals by the electronic receiver 34 from the electronic transmitter coupled to the electronic device 40. The continuous/intermittent electronic signals received by the electronic receiver 34 comprises a variety of electronic signals such as but not limited to a calendar appointment notification signal, an e-mail notification signal, a current local weather signal, a current altitude signal, a current local temperature signal, a current local pressure signal, a current stock ticker signal, a current sport score signal, a current news flash signal, a video conferencing signal, an advertisement signal, a photographic image signal, a motion video signal, an audio signal, a social media notification signal, and a current GPS navigation signal.

In an exemplary embodiment, each of the continuous/intermittent electronic signals may be selectively digitally displayed on the display panel 65 of the smart clip 30 to be observed by the user. More specifically, in an exemplary embodiment, a variety of continuous/intermittent electronic signals may be received from a variety of external, transmitting sources to the electronic receiver coupled to the electronic device 40. Electronic receiver 34 may be configured to receive any electronic signal from the electronic device 40 that is received from the variety of external transmitting sources to the electronic receiver coupled to the electronic device 40. In a further exemplary embodiment, electronic receiver 34 may be programmable to receive a desired selection of electronic signals from the electronic device 40. More specifically, electronic receiver 34 may be programmable to receive a desired selection of electronic signals using software applications from a variety of electronic devices including a cell phone, a remote control device, a personal computer, a smart clip, a wrist watch, or any other electronic device known in the art.

In an exemplary embodiment, smart clip 30 may be shatter resistant. More specifically, the smart clip 30 may be manufactured from any material known in the art that prevents the smart clip 30 from shattering when it is dropped from a height and impacts on a hard surface.

In an embodiment of the current invention, the control unit 12 is connected to a temperature transducer (not shown) such as a thermocouple. The temperature transducer is coupled to one of the upper surface 82, the lower surface 84, and the connecting surface 86 and converts temperature to an electronic signal. More specifically, the control unit 12 may be configured to receive the electronic signal from the temperature transducer that may be indicative of a temperature of atmospheric air/temperature of an article gripped by the smart clip 30 and in contact with the temperature transducer. The control unit 12 may be connected to the display panel 65. The control unit 12 facilitates digitally displaying the temperature of atmospheric air/temperature of the article in the display panel 65 to notify the user of the temperature of atmospheric air/temperature of the article. If the temperature of the article gripped by the smart clip 30 is below a predetermined temperature/above a predetermined temperature, a notification signal is transmitted from the electronic transmitter of the smart clip 30 to the electronic device 40 to notify the user. Alternatively, the temperature transducer is coupled to an underside of one of the upper surface 82, the lower surface 84, and the connecting surface 86.

The smart clip 30 may be remotely programmed by the electronic device 40. In an exemplary embodiment, the electronic receiver 34 may be connected to the control unit 12 through a control flow path. More specifically, the electronic device 40 facilitates programming the document expiry date/document expiry time in the smart clip 30 from a remote location by transmitting an electronic signal to the electronic receiver 34. The audible alarm may be connected to the control unit 12. The audible alarm may be activated to emit an alarm by transmitting an electronic signal from the electronic device 40 remotely to the electronic receiver 34 when the smart clip 30 has been misplaced. In an exemplary embodiment, the control unit 12 may be coupled to the electronic transmitter coupled to the smart dip 30.

In an exemplary embodiment, a first light emitting diode (LED) 91, a second light emitting diode 92, and a third light emitting diode 93 may be coupled to one of the upper surface 82, the lower surface 84, and the connecting surface 86 of the smart clip 30. The first light emitting diode 91, the second light emitting diode 92, and the third light emitting diode 93 may each be connected to the control unit 12 through control flow paths (not shown). The first light emitting diode 91, the second light emitting diode 92, and the third light emitting diode 93 may be of three different colors. Specifically, the first light emitting diode 91 may be green, the second light emitting diode 92 may be amber, and the third light emitting diode 93 may be red. Alternatively, the first light emitting diode 91, the second light emitting diode 92, and the third light emitting diode 93 may be of any colour known in the art that enables functioning of the first light emitting diode 91, the second light emitting diode 92, and the third light emitting diode 93 herein. The control unit 12 activates the first light emitting diode 91 to glow during a first time interval. The first time interval occurs as soon as the document expiry time/document expiry date has been programmed in the timer 55. After a certain period of time has elapsed, the control unit 12 activates the second light emitting diode 92 to glow during a second time interval while the first light emitting diode 91 may or may not cease to glow. The second time interval begins at an expiry of the first time interval. As the current time/current date begins to approach the document expiry time/document expiry date, the control unit 12 activates the third light emitting diode 93 to glow during a third time interval while the second light emitting diode 92 may or may not cease to glow. The third time interval begins at an expiry of the second time interval. In an embodiment, after the document expiry time/document expiry date has lapsed, the third light emitting diode 93 continues to glow for a certain time duration that may be pre-programmed by the user. In an alternate embodiment, after the document expiry time/document expiry date has been attained, the third light emitting diode 93 may be deactivated.

The control unit 12 may activate the first light emitting diode 91, the second light emitting diode 92, and the third light emitting diode 93 in accordance with a sleep function. Specifically, the control unit 12 may deactivate the first light emitting diode 91, the second light emitting diode 92, and the third light emitting diode 93 periodically to conserve battery power. Alternatively, the control unit 12 may activate the first light emitting diode 91, the second light emitting diode 92, and the third light emitting diode 93 to glow intermittently to conserve battery power. In an alternate embodiment, the control unit 12 may deactivate all the electronic components that are connected to the control unit 12 periodically to conserve battery power. After a predetermined time interval has lapsed, the control unit 12 may automatically power and activate all the electronic components that are connected to the control unit 12 for normal functioning of the smart clip 30.

In an exemplary embodiment, the smart dip 30 may be provided with an electrical resistance coil (not shown). The electrical resistance coil may be coupled within a recess defined in one of the upper surface 82, the lower surface 84, and the connecting surface 86 of the smart clip 30. In an alternate exemplary embodiment, the electrical resistance coil may be connected to any portion of the smart clip 30 using any fastening means known in the art. More specifically, the electrical resistance coil may be connected to a switch (not shown) that may be activated by the user to power the electrical resistance coil. In an alternate exemplary embodiment, the electrical resistance coil may be connected to the control unit 12 via a control flow path (not shown) and may be activated by the user to power the electrical resistance coil. The electrical resistance coil may therefore be operated to function as a cigarette lighter by the user. In an alternate exemplary embodiment, a flame burner (not shown) may be connected to a fuel storage tank. The fuel storage tank may be used to supply fuel to the flame burner, which when ignited generates a flame when the switch is pressed by the user. In an alternate exemplary embodiment, the electrical resistance coil/flame burner that is coupled to the fuel storage tank may be any device known in the art that is coupled to one of the upper surface 82, the lower surface 84, and the connecting surface 86 of the smart clip 30 that facilitates lighting a cigarette or any other flammable material. A spring actuated/mechanically actuated/sliding mechanism flap (not shown) may be provided on the smart clip 30 to cover the electrical resistance coil. More specifically, the flap may be actuated to open/close, thereby allowing the user to gain access to the electrical resistance coilonly when it is required. In an embodiment, the electrical resistance coil may be configured to be activated only when the flap is actuated to open. The flap that may be provided on one of the upper surface 82, the lower surface 84, and the connecting surface 86 of the smart clip 30 facilitates the user to avoid any potential accidents which may otherwise result if the hot electrical resistance coilis uncovered while it is in a heated state.

The smart clip 30 includes a magnetic compass (not shown) coupled to one of the upper surface 82, the lower surface 84, and the connecting surface 86 of the smart clip 30. More specifically the magnetic compass consists of a small, lightweight needle balanced on a nearly frictionless pivot point. One end of the needle is marked "N" for North, or coloured to indicate that it points towards North. The magnetic compass facilitates providing a directional guide to the user. In an alternate exemplary embodiment, the magnetic compass may be integrally formed on one of the upper surface 82, the lower surface 84, and the connecting surface 86 of the smart clip 30. In an exemplary embodiment, the magnetic compass may be connected to the control unit 12 through a control flow path and displays the magnetic north in the display panel 65.

The smart clip 30 includes a heart rate sensor (not shown) that may be coupled to the smart clip 30. More specifically, the heart rate sensor may be coupled to one of the upper surface 82, the lower surface 84, and the connecting surface 86 of the smart clip 30, and determines the user's heart rate. The user may position the heart rate sensor against his thumb or any other portion of his body for a pre-determined time interval, allowing the heart rate sensor to sense the user's heart rate. The heart rate sensor may be connected to the control unit 12 through a control flow path. An electronic signal from the heart rate sensor may be transmitted to the control unit 12 that is indicative of the user's heart rate. The control unit 12 may be configured to determine the user's heart rate from the electronic signal that may be received from the heart rate sensor. The control unit 12 facilitates digitally displaying the user's heart rate in the display panel 65.

The smart clip 30 includes a location tracking module that may be coupled to the smart clip 30. More specifically, the location tracking module may be coupled to one of the upper surface 82, the lower surface 84, and the connecting surface 86 of the smart clip 30, and determines the location of the smart clip 30. The location of the smart clip 30 is saved in the electronic device 40 by outputting a signal from a transmitter of the location tracking module. The electronic device 40 may then output the saved location upon receiving a request from the user. For example, when the user is trying to determine the location of the smart clip 30, the user may prompt the electronic device 40 to output the saved location. The location may be outputted as a mark on a map, which may be displayed on the electronic device 40. The location tracking module may also be tracked by a GPRS network, a GPS network, RFD, Wi-Fi, and the like in real time from the electronic device 40. As such the user may be able to use the map to locate the smart clip 30. The location tracking module may be connected to the control unit 12 through a control flow path.

In an exemplary embodiment, smart clip 30 may be provided with a stop watch (not shown). More specifically, the stop watch may be coupled to the smart clip 30 for timing an event. The user may activate the stop watch when an event begins, and deactivate the stop watch after the event has terminated. The stop watch may be connected to the control unit 12 via a control flow path. In an exemplary embodiment, the stop watch may be remotely controlled by the user by transmitting an electronic signal from the electronic device 40 to the electronic receiver 34. The count down on the stop watch may be displayed on the display panel 65.

The smart clip 30 may be provided with an AM/FM radio receiver (not shown) that may be connected to the display panel 65. More specifically, the user may monitor a current radio station displayed on the display panel 65, and toggle between various AM/FM radio stations using the touch screen selector provided on one of the upper surface 82, the lower surface 84, and the connecting surface 86 of the smart clip 30. In an exemplary embodiment, the AM/FM radio receiver may be integrally or removably coupled to the smart clip 30. The AM/FM radio receiver comprises a radio tuner having a radio frequency input and an audio output for providing a radio audio signal. The AM/FM radio receiver may be connected to a speaker. The radio audio signal may be transmitted from the AM/FM radio receiver to the speaker via a plurality of electronic modulating components for communicating the radio audio signal to the user. The volume level of the speaker may be increased or decreased using the touch screen selector provided on the smart clip 30. In an alternate exemplary embodiment, an AM/FM radio signal may be transmitted from the electronic device 40 to the electronic receiver 34 that is coupled to the smart clip 30. The AM/FM radio receiver may be connected to the control unit 12 through a control flow path. A headphone output port may be provided on the smart clip 30. The radio audio signal may be transmitted from the AM/FM radio transmitter to the headphone output port via a plurality of electronic modulating components for communicating the radio audio signal to the user.

The smart clip 30 may be provided with a digital music player (not shown) that may be connected to the display panel 65. More specifically, the user may select a desired song track from a plurality of songs tracks stored in the memory unit 52 using the touch screen selector provided on one of the upper surface 82, the lower surface 84, and the connecting surface 86 of the smart clip 30. The digital music player may be connected to one of the speaker and the headphone output port. A desired song track signal may be transmitted from the digital music player to one of the speaker and the headphone output port in order to play the desired song track for the user. In an alternate exemplary embodiment, the digital music player may be remotely controlled by the user by transmitting an electronic signal from the electronic device 40 to the electronic receiver 34 of the smart clip 30. The digital music player may be connected to the control unit 12 through a control flow path.

The smart clip 30 may be provided with a digital camera and/or motion video recorder (not shown). More specifically, the digital camera and/or motion video recorder may be coupled to one of the upper surface 82, the lower surface 84, and the connecting surface 86 of the smart clip 30 and allows the user to capture high resolution photographic images and/or audio and video recordings. In an alternate exemplary embodiment, the digital camera and/or motion video recorder may be integrally coupled to one of the upper surface 82, the lower surface 84, and the connecting surface 86 of the smart clip 30. The digital camera may be used to capture high resolution images as well as audio and video recordings. The digital camera and/or motion video recorder may be activated and deactivated by the user using the touch screen selector provided on one of the upper surface 82, the lower surface 84, and the connecting surface 86 of the smart clip 30. The digital camera and/or motion video recorder may be connected to the memory unit 52. More specifically, the memory unit 52 may be configured to store/retrieve the captured images and/or audio and video recordings. The electronic transmitter of the smart clip 30 may be configured to transmit the captured images and/or audio and video recordings from the memory unit 52 to the electronic receiver that is coupled to the electronic device 40. In an alternate exemplary embodiment, the captured images and/or audio and video recordings may be transmitted to the electronic receiver that is coupled to the electronic device 40 wirelessly from the digital camera and/or motion video recorder. The captured images and/or audio and video recordings may also be transmitted from the digital camera and/or motion video recorder to any electronic device known in the art such as but not limited to a personal computer, a wireless router, a Bluetooth® device, a smart phone, a wrist watch, and a smart clip. The digital camera and/or motion video recorder may be connected to the control unit 12 through a control flow path.

In an exemplary embodiment, smart clip 30 may be provided with a pedometer (not shown). More specifically, the pedometer may be coupled to one of the upper surface 82, the lower surface 84, and the connecting surface 86 of the smart clip 30. The user may carry the smart clip 30 in his person, thereby allowing the pedometer to sense a number of parameters. The pedometer may be connected to the control unit 12 through a control flow path. An electronic signal from the pedometer may be transmitted to the control unit 12 that is indicative of the parameters that have been sensed by the pedometer. The control unit 12 may be configured to determine the parameters from the electronic signal received from the pedometer. The parameters include but are not limited to a number of steps traversed by the user, a time traversed by the user, a distance that has been covered by the user, a speed at which the user is travelling, a distance that remains to be covered after the user has traversed a certain distance, and a number of calories expended by the user. The control unit 12 facilitates digitally displaying the parameters on the display panel 65 to notify the user of the parameters determined by the control unit 12.

The smart clip 30 includes a battery compartment 54. The battery compartment 54 may be provided within a recessed portion defined within the smart clip 30. Specifically, the battery compartment 54 may be provided within an inner portion of the upper surface 82, an inner portion of the lower surface 84, or an inner portion of the connecting surface 86. In an alternate exemplary embodiment, the battery compartment 54 may be coupled to the smart clip 30. The battery compartment 54 comprises at least one pair of positive and negative polarity electrical leads (not shown). The positive and negative polarity electrical leads are configured to receive a rechargeable battery therein. The control unit 12 may be connected to the positive and negative polarity electrical leads through a control flow path to constitute a closed loop electrical circuit. In an exemplary embodiment, power supplied by the rechargeable battery to the positive and negative polarity electrical leads powers the control unit 12. Therefore, all electronic components that have been described above and integrated/coupled to the smart clip 30 and connected to the control unit 12 may be electric ally powered by the power supplied to the positive and negative polarity electrical leads by the rechargeable battery. The display panel 65 may be connected to the rechargeable battery and displays a current level of battery power of the rechargeable battery.

The smart clip 30 may be coupled to a solar power source (not shown). Specifically, the upper surface 82, the lower surface 84, and the connecting surface 86 may each be a solar power source. In an exemplary embodiment, the solar power source may be a solar panel. The solar power source may be electrically connected to the rechargeable battery that is received between one of the positive and negative polarity electrical leads to facilitate recharging the rechargeable battery. In an alternate embodiment, the solar power source may be connected to one of the positive and negative polarity electrical leads, the electronic receiver 34, the timer 55, and the control unit 12, and may be electrically powered by the power supplied from the solar power source.

In an exemplary embodiment, the smart clip 30 includes a battery charging port that may be coupled to one of the upper surface 82, the lower surface 84, and the connecting surface 86 of the smart clip 30. More specifically, the battery charging port may be coupled to each pair of the positive and negative polarity electrical leads through control flow paths. More specifically, the battery charging port of the smart clip 30 may be placed on a battery charging station for charging the rechargeable battery. In an alternate exemplary embodiment, any battery charger known in the art may be electrically connected to the battery charging port for charging the rechargeable battery. In yet another alternate exemplary embodiment, power may be supplied directly to the control unit 12 using an external power source through a control flow path.

An inductive battery charger (not shown) may be provided which is platform shaped and is provided with a charging coil. When the charging coil in the inductive battery charger is energized, the charging coil creates magnetic flux lines. An inductive battery charging port-coupled to one of the upper surface 82, the lower surface 84, and the connecting surface 86 of the smart clip 30 is in a non-direct electrical contact relationship with respect to the inductive battery charger. The inductive battery charging port includes a pick-up coil which will have an electrical current induced therein when the inductive battery charging ports are positioned adjacent to the inductive battery charger, and the inductive battery charger is energized. The smart clip 30 includes circuit means for rectifying the induced current in the pick-up coil to charge the rechargeable battery received within the positive and negative polarity electrical leads. The circuit means includes a rectifier and a current limiting resistor so that the rechargeable battery is self regulating in terms of current and overcharge.

The smart clip 30 may include a Universal Serial Bus (USB) port (not shown). The Universal Serial Bus port may be electronically connected to the control unit 12 through a control flow path. The control unit 12 may be electronically connected to the memory unit 52 through a control flow path. In an exemplary embodiment, a battery charging device or an external data transmitting device such as a Universal Serial Bus memory device may be connected to the Universal Serial Bus port. More specifically, in an exemplary embodiment, the battery charging device that is connected to the Universal Serial Bus port may be used to charge the rechargeable battery that is in electrical communication with the positive and negative polarity electrical leads. In an exemplary embodiment, an external power source may be used to supply electrical power to the control unit 12 directly by bypassing the battery compartment 54 of the smart clip 30. In an alternate exemplary embodiment, the external data transmitting device that is connected to the Universal Serial Bus port may be used to transmit a document expiry date, document expiry time, audio files, video files, image files, multimedia files and the like. The audio file formats may include, but are not limited to MP3, AIFF, WAV, MPEG-4, AAC, and Apple Lossless. Example file formats for media content include, but are not limited to files having extensions doe, dot, wpd, txt, xls, pdf, ppt, jpg, jpeg, png, bmp, gif, html, htm, zip, tif, tiff, and wmf. In an exemplary embodiment, the files that are transmitted from the external data transmitting device are stored within the memory unit 52 of the smart clip 30.

In an exemplary embodiment, the smart clip 30 includes a digital display screen (not shown) that may be circumferentially coupled to one of the upper surface 82, the lower surface 84, and the connecting surface 86 of the smart clip 30. More specifically, a touch screen selector may be connected to the digital display screen and may be operated by the user to display motion videos and photographic images on the digital display screen. The digital display screen may be connected to the control unit 12 through a control flow path. The motion videos and photographic images that may be displayed on the digital display screen may be received from the memory unit 52 of the smart clip 30. In an alternate exemplary embodiment, the motion videos and photographic images that may be displayed on the digital display screen may be received from an external Universal Serial Bus memory device that may be-connected to the Universal Serial Bus port. In an exemplary embodiment, the digital display screen may be an LCD screen, TFT screen, TFT active matrix screen, black and white screen, CSTN screen, and a plasma screen. Alternatively, the digital display screen may be any display screen known in the art that is capable of displaying motion videos and photographic images therein. More typically, the digital display screen includes a speaker, a headphone output port, or similar devices for producing an audio signal for the content displayed on the digital display screen. The digital display screen has a resolution from about 240×320 to 480×640 and preferably is a 16-18 bit color screen for displaying motion videos and photographic images therein. The digital display screen may be coupled circumferentially to the smart clip 30 such that a portion of the smart clip 30 that includes various electronic sensors, display panel 65, switches, etc, do not constitute a portion of the digital display screen. In an alternate exemplary embodiment, all user selector options for running any application may be performed using the touch screen selector that is integrated in the digital display screen.

The digital display screen of the smart clip 30 may be configured to receive a plurality of electronic signals from the electronic receiver 34 through the control unit 12. More specifically, the plurality of electronic signals received from the electronic receiver 34 comprises a plurality of pop up advertisements that may be transmitted by a number of vendors. The pop up advertisements may be transmitted by various vendors such as coffee shops, fast food establishments, confectionery stores, airports, railway stations, book stores, and the like with special offers/promotional coupons/product deals/advertisements to the electronic receiver 34 that is coupled to the smart clip 30. The pop up advertisements may be transmitted to the electronic receiver 34 from a remote computer server or from the electronic transmitter that may be coupled to the electronic device 40. In an exemplary embodiment, the pop up advertisements that may be displayed on the digital display screen are a function of a time of day, a user's geographical location, a user's preference, and the like. In an exemplary embodiment, when the user is proximate to a coffee shop on an early morning, the coffee shop advertisement/promotional offer may be transmitted by a coffee shop computer server to the electronic device 40/electronic receiver 34. After the user has selected the advertisement/promotional offer using the touch screen selector that may be integrated in the digital display screen, a GPS navigation map may be displayed on the digital display screen directing the user from his current geographical location to the coffee shop. In an alternate exemplary embodiment, when the user is within an airport, the business establishments that are located within the airport may transmit advertisements/groupons/discount offers on various products and services offered by the business establishments to the electronic receiver 34 from a remote computer server. In an exemplary embodiment, if the user has a preference for a certain business establishment, advertisements from that specific business establishment may be transmitted frequently to the electronic receiver 34 from the remote computer server. Therefore, the smart clip 30 may be adapted to learn the user's product preferences over time and receive special offers/promotional coupons/product deals/advertisements from only those business establishments that appeal to the user. In an alternate exemplary embodiment, the smart clip 30 may be manually customizable by the user to receive and display special offers/promotional coupons/product deals/advertisements from select business establishments that appeal to the user. In another embodiment, the pop up advertisements may be stored within the memory unit 52 and displayed on the digital display screen when the smart clip 30 is in an offline mode. In an exemplary embodiment, the digital display screen may be the display panel 65.

In addition to providing special offers/promotional coupons/product deals/advertisements, etc. the electronic receiver 34 may be configured to receive alerts from a variety of sources. As an example, alerts from an airport terminal server may be transmitted to the electronic receiver 34 and displayed on the digital display screen regarding the user's current flight timing, flight delay alerts, alert messages for flight boarding, etc. The alerts from the airport terminal server may be transmitted in real time to the electronic receiver 34 thereby allowing the user to track and stay updated on the current status of his flight.

The smart clip 30 may be connected to an internet network through a Wi-Fi network/wireless router. More specifically, the electronic receiver 34 of the smart clip 30 may be connected to the Wi-Fi/wireless router and may be configured to receive data over the internet. In an embodiment, the digital display screen that may be coupled to the smart clip 30 may be used to browse through websites, social media, read e-mail, compose e-mail messages, make product selections, and purchase products/services online through a web browser that may be displayed on the digital display screen. The electronic transmitter of the smart clip 30 may be connected to the Wi-Fi/wireless router and may be configured to transmit data over the internet.

The digital display screen of the smart clip 30 may be used to display a plurality of screen savers when the smart clip 30 is not in use. More specifically, the timer 55 coupled to the smart clip 30 determines if the smart clip 30 has not been used for a pre-determined time interval. If the smart clip 30 has not been used by the user for the pre-determined time interval, the digital display screen displays a plurality of screen savers. Examples of screen savers include changing colour of the digital display screen at periodic time intervals, screen saver pictures, photographs, etc. Moreover, the digital display screen may be configured to display different colours when different electronic signals are received by the electronic receiver 34. The digital display screen may also be configured to display a different colour when different notifications, advertisements, etc. may be received by the electronic receiver 34 of the smart clip 30.

The smart clip 30 includes a bump sensor (not shown) that may be coupled to the smart clip 30. The bump sensor may be connected to the control unit 12 through a control flow path. In an exemplary embodiment, when the bump sensor comes in contact with a bump sensor of another smart clip or electronic device, the contact information of the user may be transmitted from the smart clip 30 to the other smart clip or electronic device. More specifically, the contact information of the user may be retrieved from the memory unit 52 and transmitted via the electronic transmitter of the smart clip 30 to an electronic receiver that may be coupled to the other smart clip or electronic device, and vice versa. In an exemplary embodiment, any electronic information contained in the memory unit 52 of the smart clip 30 may be programmed by the user to be transmitted via the transmitter to the electronic receiver that may be coupled to the other smart clip or electronic device.

The smart clip 30 includes a speed sensor (not shown) that may be coupled to one of the upper surface 82, the lower surface 84, and the connecting surface 86 of the smart clip 30. The speed sensor may be connected to the control unit 12 through a control flow path. In an exemplary embodiment, the speed sensor may be used to determine a speed at which the user that is in possession of the smart clip 30 is travelling. The speed at which the user may be travelling may be displayed in the display panel 65 to notify the user of the user's current speed of travel.

In an exemplary embodiment, an alcohol sensor (not shown) may be coupled to the smart clip 30. More specifically, the alcohol sensor may be configured to measure a concentration of alcohol consumed by the user. More specifically, the user may position the alcohol sensor within proximity of his mouth for a pre-determined time interval, allowing the alcohol sensor to detect the concentration/content of alcohol in the user's breath. The control unit 12 may be connected to the alcohol sensor through a control flow path. An electronic signal from the alcohol sensor may be transmitted to the control unit 12 that may be indicative of the concentration/content of alcohol in the user's breath. The control unit 12 facilitates digitally displaying the concentration/content of alcohol in the user's breath in the display panel 65 to notify the user. The control unit 12 facilitates digitally displaying a safe/legal permissible concentration/content of alcohol in the display panel 65 to notify the user of the acceptable concentration/content of alcohol for safe driving. If the concentration/content of alcohol in the user's breath is greater than the acceptable concentration/content of alcohol for safe driving/legal limit, the control unit 12 transmits an electronic signal to the audible alarm to notify the user that the concentration/content of alcohol in the user's breath is greater than the acceptable concentration/content of alcohol for safe driving/legal limit.

In an exemplary embodiment, the electronic transmitter of the electronic device 40 is connected to the electronic receiver 34 and is configured to transmit an electronic signal to the electronic receiver 34. The electronic transmitter is in electronic communication with the electronic receiver 34 that is coupled to the smart clip 30. More specifically, electronic receiver 34 is configured to receive the electronic signal from the electronic transmitter in the form of a programmed expiry date/expiry time. Electronic receiver 34 is further configured to be connected to the timer 55. More specifically, the timer 55 is configured to facilitate counting down from a present date/present time to the programmed expiry date/expiry time.

The smart clip and electronic device 10 may be used to conserve battery power in the electronic device 40. In addition, transmitting an electronic signal comprising the current date/current time to the smart clip 30 enables the user to travel between various national/international time zones, and still be equipped to receive the current date/time at a specific geographical location. Moreover, transmitting a variety of continuous/intermittent electronic signals at user desired ranges that include a calendar appointment notification signal, an e-mail notification signal, a current weather signal, a current altitude signal, a current temperature signal, a current pressure signal, a current stock ticker signal, a current sport score signal, a current news flash signal, a ring tone signal, a video conferencing signal, a current GPS navigation signal, an advertisement signal, a photographic image signal, a motion video signal, an audio signal, a social media notification signal, and the like from the electronic device 40 to the electronic receiver 34 of the smart clip 30 eliminates the requirement of integrated transducer devices for measuring, determining, and notifying a few of the parameters mentioned above to the user. Therefore a cost incurred to the user may be substantially reduced, while simultaneously enhancing the utility value of the smart clip 30. Moreover, applications created in the electronic device 40 for the smart clip 30 may be transmitted to the electronic receiver 34 of the smart clip 30 such that the applications may be accessed by the user using the display panel 65 that may be coupled to the smart clip 30.

The above described smart clip and electronic device 10 is cost effective. In addition, the modular nature of each sub-system of the smart clip and electronic device 10 facilitates easy disassembly and replacement of individual system components as required.

Exemplary embodiments of a smart clip and electronic device are described above in detail. The system is not limited to the specific embodiments described herein, but rather, components of each system may be utilized separately and independently from other components described herein.

While the invention has been described in terms of various specific embodiments, those skilled in the art will recognize that the invention can be practiced with modifications within the spirit and scope of the claims.

What is claimed is:

1. A method for receiving an expiry time in a smart clip and one of timing and counting down to the expiry time, wherein the smart clip comprises an upper surface and a lower surface for gripping an article therebetween, and a connecting surface that connects the upper surface and the lower surface, a display panel disposed on one of the upper surface and the lower surface, and at least one indicator disposed on the connecting surface, the method comprising:

coupling an electronic receiver to the smart clip;

connecting a timer to the electronic receiver;

receiving the expiry time by the electronic receiver;

one of timing and counting down to the expiry time by the timer;

displaying on the display panel one of timing and counting down to the expiry time; and activating the at least one indicator in at least one time interval during the one of timing and counting down to the expiry time.

2. A method in accordance with claim 1, further comprising:

connecting a memory unit to the electronic receiver;

storing the expiry time in the memory unit.

3. A smart clip, said smart clip comprising:

an upper surface and a lower surface for gripping an article therebetween, and a connecting surface that connects the upper surface and the lower surface;

a display panel disposed on one of the upper surface and the lower surface;

at least one indicator disposed on the connecting surface;

an electronic receiver for receiving an expiry time;

a timer connected to said electronic receiver, said timer one of timing and counting down to the expiry time;

said display panel connected to said timer, said display panel displaying one of timing and counting down to the expiry time;

said at least one indicator activated in at least one time interval during one of timing and counting down to the expiry time.

4. A smart clip in accordance with claim 3, wherein said electronic receiver receives the expiry time from at least one of a cell phone transmitter, a wrist watch transmitter, a remote control device transmitter, and a microphone.

5. A smart clip in accordance with claim 3, further comprising:

a memory unit connected to said electronic receiver, said memory unit stores the expiry time.

6. A smart clip in accordance with claim 5, further comprising one of a battery charging receiving terminal and an inductive battery charging receiving terminal coupled to one of said upper surface, said lower surface, and said connecting surface, one of said battery charging receiving terminal and said inductive battery charging receiving terminal charges at least one battery inserted in said smart clip.

7. A smart clip in accordance with claim 6, wherein said display panel is connected to said at least one battery, said display panel displays a current level of battery power of said at least one battery.

8. A smart clip in accordance with claim 3, further comprising a solar power source integrated in said smart clip, said solar power source powers said smart clip.

9. A smart clip in accordance with claim 3, further comprising an electronic transmitter connected to said timer, said electronic transmitter transmits an electronic signal to one of a cell phone receiver, a wrist watch receiver, a remote control device receiver, and a speaker.

10. A smart clip in accordance with claim 9, wherein the electronic signal comprises one of: an expiry notification signal; and a low battery power notification signal.

11. A smart clip in accordance with claim 9, further comprising a control unit connected to at least one of said electronic receiver, said timer, and said electronic transmitter.

12. A smart clip in accordance with claim 11, further comprising one of a vibrating unit and an ultrasonic frequency noise generator connected to one of said control unit, said timer, and said electronic transmitter, one of said vibrating unit and said ultrasonic frequency noise generator activated by one of said control unit, said timer, and said electronic transmitter at the expiry time.

13. A smart clip in accordance with claim 3, said plurality of indicators comprising a first light emitting diode, a second light emitting diode, and a third light emitting diode coupled to said connecting surface, wherein said first light emitting diode is activated to glow during a first time interval, wherein said second light emitting diode is activated to glow during a second time interval, said second time interval occurs at an expiry of said first time interval, and wherein said third light emitting diode is activated to glow during a third time interval, said third time interval occurs at an expiry of said second time interval.

14. A smart clip in accordance with claim 3, further comprising a location tracking module coupled to one of said upper surface, said lower surface, and said connecting surface, said location tracking module determines a location of said smart clip.

15. A smart clip in accordance with claim 3, further comprising at least one of an electrical resistance coil, a flame burner, a compass, a heart rate sensor, a radio receiver, a digital music player, a pedometer, a USB port, a bump sensor, a speed sensor, and an alcohol sensor coupled to one of said upper surface, said lower surface, and said connecting surface of said smart clip.

16. A smart clip in accordance with claim 3, further comprising a security code received by said electronic receiver to validate an identity of a user.

17. A smart clip in accordance with claim 3, further comprising a camera coupled to one of said upper surface, said lower surface, and said connecting surface, said camera captures at least one of a photographic image and a video recording.

18. A smart clip in accordance with claim 3, wherein said electronic receiver receives at least one of a calendar appointment notification signal, an e-mail notification signal, a current local weather signal, a current altitude signal, a current local temperature signal, a current local pressure signal, a current stock ticker signal, a current sport score signal, a current news flash signal, a video conferencing signal, an advertisement signal, a photographic image signal, a motion video signal, an audio signal, a social media notification signal, and a current GPS navigation signal.

19. A smart clip in accordance with claim 3, further comprising a temperature transducer coupled between said upper surface and said lower surface, said temperature transducer converts a temperature of an article gripped between an upper gripping edge and a lower gripping edge of said smart clip to an electronic signal.

20. A smart clip, said smart clip comprising:

an upper surface and a lower surface for gripping an article therebetween, and a connecting surface that connects said upper surface and said lower surface;

a control unit coupled to one of the upper surface, the lower surface, and the connecting surface;

a display panel disposed on one of the upper surface and the lower surface and connected to said control unit; and at least one indicator disposed on the connecting surface and connected to said control unit, wherein said control unit activates said at least one indicator in at least one time interval.

* * * * *